US008926077B2

(12) United States Patent
LaCaze et al.

(10) Patent No.: US 8,926,077 B2
(45) Date of Patent: Jan. 6, 2015

(54) INK SUPPLY SYSTEM FOR INK JET PRINTERS

(71) Applicant: INX International Ink Company, Owens Cross Roads, AL (US)

(72) Inventors: John Randel LaCaze, Hampton Cove, AL (US); Jon Campbell, Huntsville, AL (US); Fenlong Lin, Madison, AL (US)

(73) Assignee: INX International Ink Company, Owens Cross Roads, AL (US)

( * ) Notice: Subject to any disclaimer, the term of this patent is extended or adjusted under 35 U.S.C. 154(b) by 0 days.

(21) Appl. No.: 13/777,845

(22) Filed: Feb. 26, 2013

(65) Prior Publication Data

US 2014/0240406 A1 Aug. 28, 2014

(51) Int. Cl.
*B41J 2/18* (2006.01)
*B41J 2/175* (2006.01)

(52) U.S. Cl.
CPC .. *B41J 2/18* (2013.01); *B41J 2/175* (2013.01); *B41J 2/17596* (2013.01)
USPC ..... 347/89

(58) Field of Classification Search
CPC ..... B41J 2002/18
USPC ..... 347/89
See application file for complete search history.

(56) References Cited

U.S. PATENT DOCUMENTS

| | | | | |
|---|---|---|---|---|
| 2,099,947 | A * | 11/1937 | Tompson et al. | 237/19 |
| 5,815,185 | A | 9/1998 | Pietrzyk | |
| 5,818,485 | A | 10/1998 | Rezanka | |
| 6,428,156 | B1 * | 8/2002 | Waller et al. | 347/89 |
| 7,182,418 | B2 | 2/2007 | Harvey et al. | |
| 2009/0195588 | A1 * | 8/2009 | Ogama | 347/17 |

* cited by examiner

*Primary Examiner* — Julian Huffman
(74) *Attorney, Agent, or Firm* — George P. Kobler; Lanier Ford Shaver & Payne P.C.

(57) ABSTRACT

An ink supply system for ink jet printers includes a recirculation tank coupled to a recirculation pump configured to provide a substantially pulseless flow of ink. A heating assembly having an ink conduit formed into a spiral in thermal contact with at least one heating element receives ink from the pump and outlets to a sensor assembly with temperature and pressure sensors that measure ink parameters both as the ink enters a printhead and is returned from the printhead. The returned ink is then ported to a recirculation tank from which the pump draws the recirculating ink. An air pump is coupled to the recirculation tank in order to maintain a substantial vacuum within the tank.

16 Claims, 7 Drawing Sheets

FIG. 3
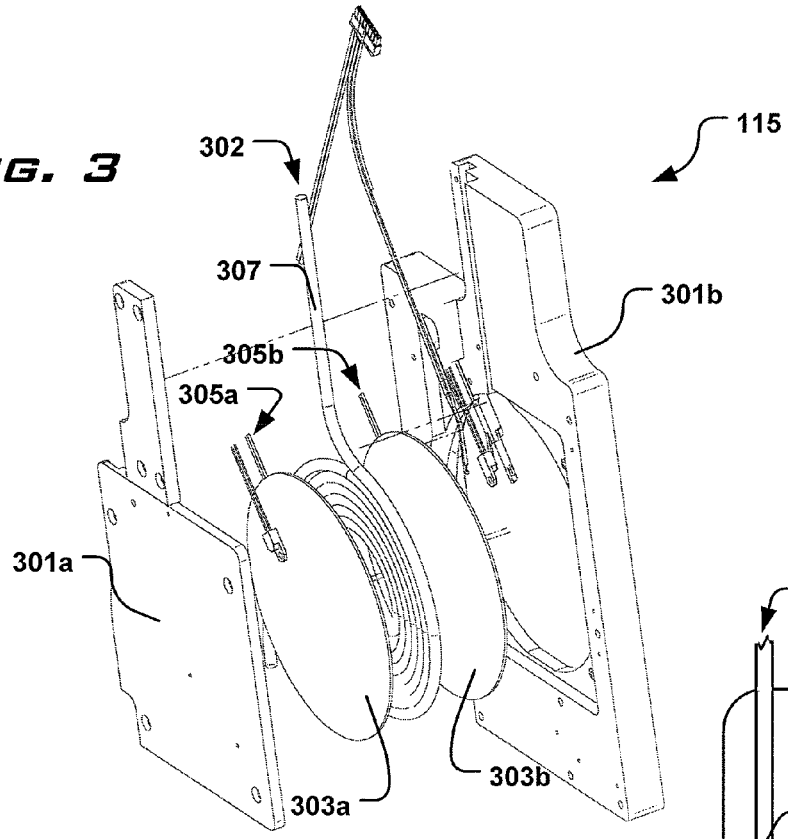
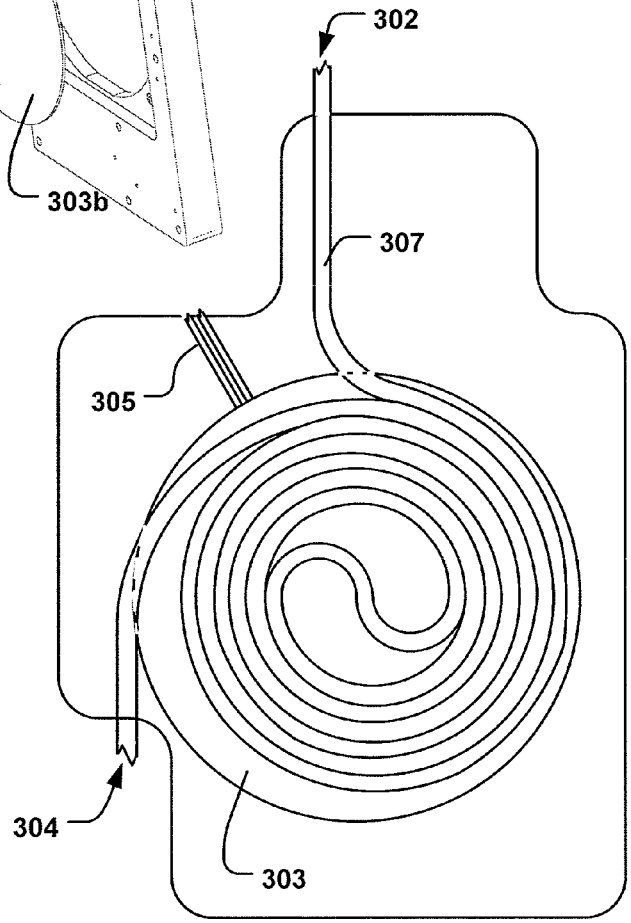
FIG. 3A

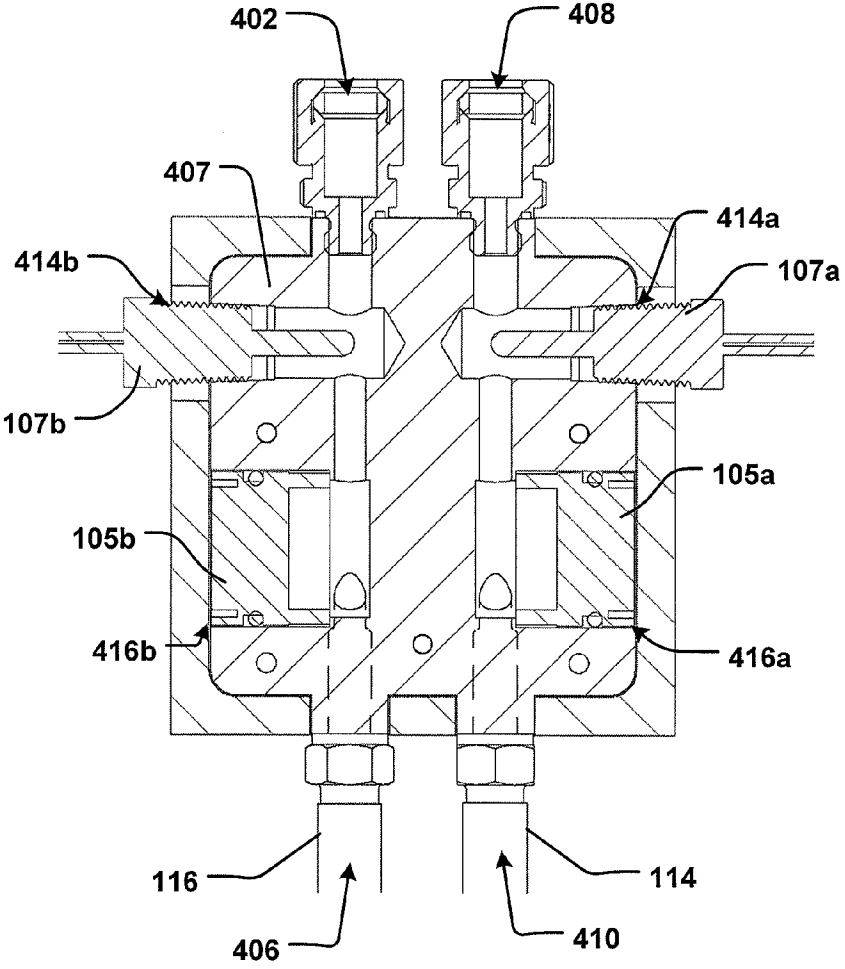
FIG. 4 C-C
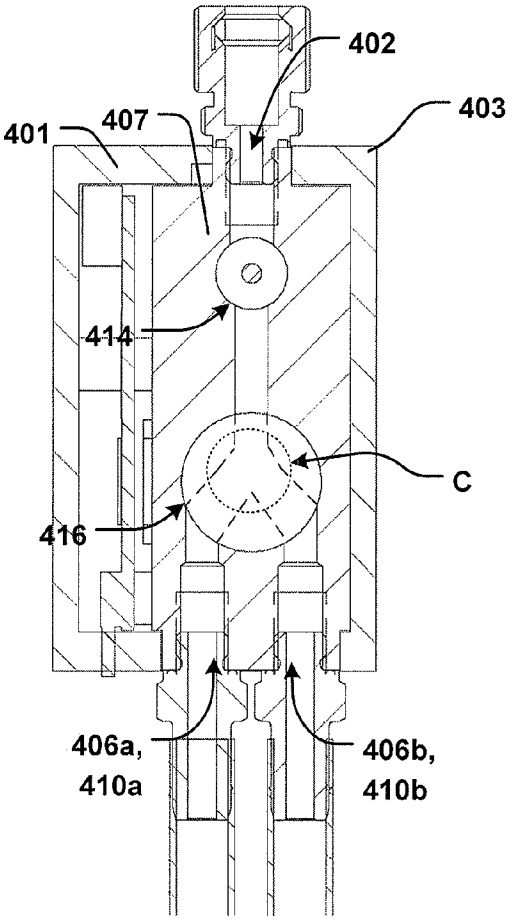
FIG. 4 B-B

INK SUPPLY SYSTEM FOR INK JET PRINTERS

BACKGROUND

1. Field

The present invention relates generally to ink jet printers, and particularly, to ink jet printers that use a recirculating ink supply.

2. Description of the Problem and Related Art

In an inkjet printer drops of ink are jetted out of nozzles of an inkjet printhead towards a receiving layer which may be e.g. specially coated paper. Usually an inkjet print head has an array of nozzles, each nozzle jetting ink to a different location possibly at the same time. The ink is jetted out of the nozzles by use of e.g. thermal or piezoelectric actuators creating a pressure wave. It is normally the intention that the size of the droplets can be kept constant or that there is a good control of the droplet size in printers capable of recording variable droplet sizes. One of the major parameters to ensure a constant drop size is that ink pressure at the printhead is stable and within a certain range suitable for the printhead used.

Ink pressure at the printhead nozzle can be kept constant using several methods. For example, small inkjet printers often employ a negative pressure generating member present in the ink reservoir mounted on the shuttle carrying the printhead. In larger printers and industrial inkjet printers an ink tank is often equipped with a system regulating and stabilizing the pressure in the tank by directly controlling the ink pressure or the pressure of the air (atmosphere) above the ink.

Another recurring issue prior designs must overcome is pressure fluctuations which result in non-uniform droplet size, decreasing the quality of the print. Such pressure fluctuations can be produced by diaphragm or impeller ink pumps. Prior systems attempt remediate these pressure fluctuations or pulses by adding pressure regulating components, resulting in large, complex and cumbersome systems. In particular, pulsing is exacerbated in large scanning printhead applications where the print media is large and the printhead traverses the media as it deposits ink thereon where the printhead is mounted to a carriage controlled by the printer system. These large prior art systems incorporate a recirculation tank (sometimes two), filters, pumps and heaters which must remain stationary because the carriage cannot bear the load scan practically. Consequently, the ink supply system must be connected to the printhead with long tubes and each time the printhead carriage stops and starts during a print job, a pressure pulse is generated in the tubes and is transmitted to the printhead. Additionally, long ink supply and return tubes mean significant thermal losses which conventional systems attempt to remediate with additional heating. However, this can result in overheating of UV curable inks which can promote premature curing and contribute to chemical instability.

SUMMARY

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

An ink supply system for ink jet printers includes a recirculation tank coupled to a recirculation pump configured to provide a substantially pulseless flow of ink. A heating assembly having an ink conduit formed into a spiral in thermal contact with at least one heating element receives ink from the pump and outlets to a sensor assembly with temperature and pressure sensors that measure ink parameters both as the ink enters a printhead and is returned from the printhead. The returned ink is then ported to a recirculation tank from which the pump draws the recirculating ink. An air pump is coupled to the recirculation tank in order to maintain a substantial vacuum within the tank.

Other embodiments will also become readily apparent to those skilled in the art from the following detailed description of the embodiments having reference to the attached figures, the invention not being limited to any particular embodiment(s) disclosed.

BRIEF DESCRIPTION OF THE DRAWINGS

In the drawings, like reference numbers indicate identical or functionally similar elements. Additionally, the left-most digit(s) of a reference number identifies the drawing in which the reference number first appears.

FIG. 3 is an exploded view of an exemplary heating assembly;

FIG. 3A is a view of the heating assembly with a housing member removed;

FIG. 4BB is a section of the sensor block assembly of FIG. 4 view along line B-B;

FIG. 4CC is a section view of the sensor block assembly of FIG. 4 view along line C-C;

DETAILED DESCRIPTION

Figure 1:
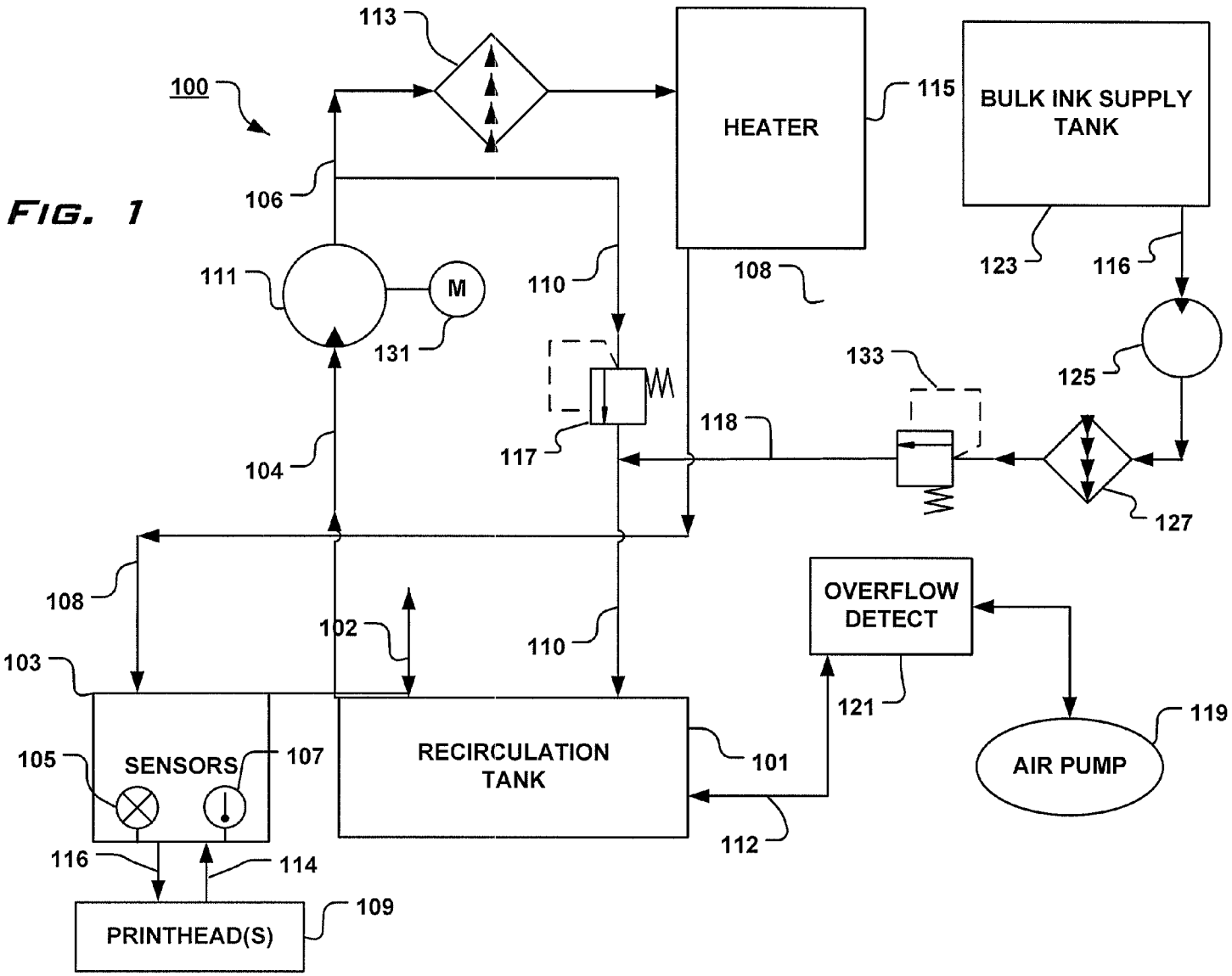
FIG. 1 is a functional schematic of an exemplary ink supply system.

The various embodiments of the present invention and their advantages are best understood by referring to FIGS. 1 through 7 of the drawings. The elements of the drawings are not necessarily to scale, emphasis instead being placed upon clearly illustrating the principles of the embodiments. Throughout the drawings, like numerals are used for like and corresponding parts of the various drawings.

Furthermore, reference in the specification to "an embodiment," "one embodiment," "various embodiments," or any variant thereof means that a particular feature or aspect of the invention described in conjunction with the particular embodiment is included in at least one embodiment of the present invention. Thus, the appearance of the phrases "in one embodiment," "in another embodiment," or variations thereof in various places throughout the specification are not necessarily all referring to its respective embodiment.

The exemplary ink supply system 100 is essentially a fluid circuit and comprises a recirculation reservoir 101 having an outflow port coupled to the suction side 104 of a recirculation pump 111, the pressure side 106 of which is coupled to a heating assembly 115 with a filter 113 interposed therebetween. However, the location of the filter 113, whether upstream or downstream of the heating assembly 115, may be any suitable location according to design preference. Locating the filter 113 upstream of the heating assembly 115 in some designs allows the heating assembly 115 to be located closer to the temperature sensors 105. Output from the heating assembly 115 is conveyed to a sensor block assembly 103 that includes pressure and temperature sensors 105, 107 respectively, and an printhead supply ink conduit 116 coupled to one or more recirculating printheads 109. Unejected ink is reintroduced into the supply system 100 via a return conduit 114. As will be discussed in greater detail below, a first pair of pressure sensor 105 and temperature sensor 107 is affixed to the printhead supply ink 116 conduit and a second set of a pressure sensor 105 and a temperature sensor 107 is affixed to the return ink 114 conduit. Consequently, pressure and temperature measurements are taken prior to entry into the printhead and upon exit therefrom. Return ink 102 flows from the sensor block assembly 103 and is ported into the recirculation reservoir 101. The system 100 includes an air pump 119 in fluid communication with the recirculation reservoir 101, with an overflow detection sensor 121 intermediately disposed. Additionally, a check valve 117 is connected to a bypass line 110 from the pressure side 106 of the recirculation pump 111 with an output flowing into the recirculation reservoir 101.

Figure 2:
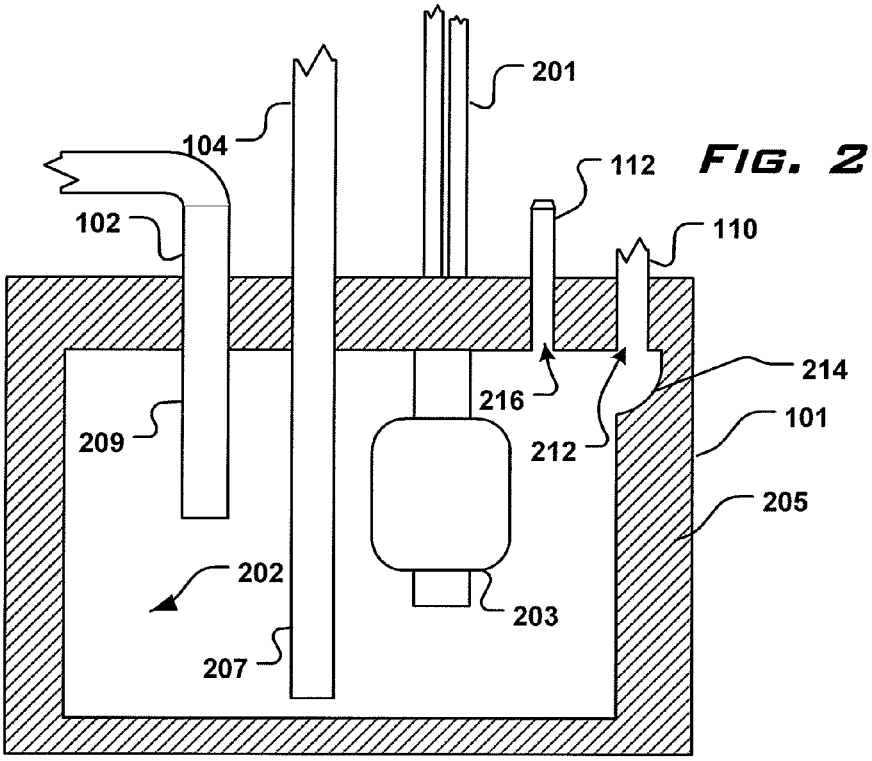
FIG. 2 is a section view of an exemplary recirculation tank adapted for use in the system.

FIG. 2 provides a cross-sectional view of an exemplary recirculation reservoir 101 which comprises a housing 205 defining the reservoir chamber 202. Within the chamber 202 a fluid level detection assembly 203, including, for example, a float, extends to a suitable depth such that a minimum threshold of ink may be detected. The fluid level detection assembly 203 is configured to generate a fluid level signal 201 that is coupled to a computer-based control system (described infra). An outflow conduit 207 is coupled to the suction side 104 of the recirculation pump 111, and an inflow conduit 209 extends into the chamber 202 for porting in return ink 102 from the sensor block 103. An inlet 212 is provided for receiving fill ink 110 introduced into the system at beginning of operation or when fluid level within the reservoir is low. The inlet 212 ports supply ink 110 onto a scalloped ledge 214 defined in the interior wall of the housing 205 to prevent ink splashing upward and interfering with the fluid level detection assembly 203 as well as to dissipate any air bubbles that may be introduced by the fill pump. An air outlet 216 is coupled to an air line 112 which is, in turn coupled to the air pump 119.

Recirculation pump 111 is selected to pulselessly impel ink within the system and to be capable of self-priming. Of course, it should be specified to deliver ink to the printheads at the desired flow and pressure. Preferably, recirculation pump 111 is a gear pump, and particularly, an external gear pump. In one embodiment, recirculation pump 111 is driven by a motor 131 to which it is magnetically coupled to eliminate dynamic seals in favor of static seals, significantly improving reliability. In addition, the motor 131 is preferably a brushless motor. It will be appreciated that the speed of the recirculation pump 111 controls the pressure of the ink in the system 100.

With reference now to FIGS. 3 & 3A, an example of a heating assembly 115 is illustrated in greater detail with first and second housing members 301*a*, 301*b*, and first and second planar heating elements 303*a*, 303*b*. Housing members 301*a*, 301*b*, provide enclosed support for control leads 305*a*, 305*b*, which supply energy to the heating elements 303*a*, 303*b*, and are coupled to a controller (discussed in greater detail below). As depicted more readily in FIG. 3A, the heating assembly supports an ink conduit 307, preferably formed into a double spiral, having an intake 302 which receives ink from the recirculation pump 111 via the filter 113, and an outlet 304 coupled to an inlet to the sensor block assembly 103. First and second heating elements 303*a*, 303*b*, are arranged on either side of the spiral. Preferably, the length of the ink conduit 307 is sufficient to allow transfer of heat generated by first and second heating elements 303*a*, 303*b*, given fluid intake temperature, flow rate and volume, as would be understood by those skilled in the relevant arts. In an exemplary embodiment, the conduit length is about three meters. This has demonstrated to be sufficient to allow the ink to leave the heating assembly 115 through outlet 304 and arrive at the sensor block 103 at about 40° C. to about 50° C. for use in the printheads. Preferably, the heating assembly 115 is suitable to increase ink temperature by about 25° C. from entry of the ink into the heating assembly 115 to its exit therefrom. However, upon first use of the system, several cycles may be required before the ink is at a suitable temperature.

Typical prior art systems heat a reservoir which transfers heat to the ink. This is inefficient generally due to low amount of surface contact area between the tank and the ink and low turbulence in the tanks. Other systems use a heat exchanger with short length of heated tube (about 1 foot). The double-spiral tube arrangement, comprising a longer tube (about three meters), is a cost effective and compact way to increase surface contact of the ink with the heated tubing, while the flow of ink provides mixing of the heated ink and insures there are no dead zones (ink sitting statically) where ink can be trapped and overheat.

Figure 4:
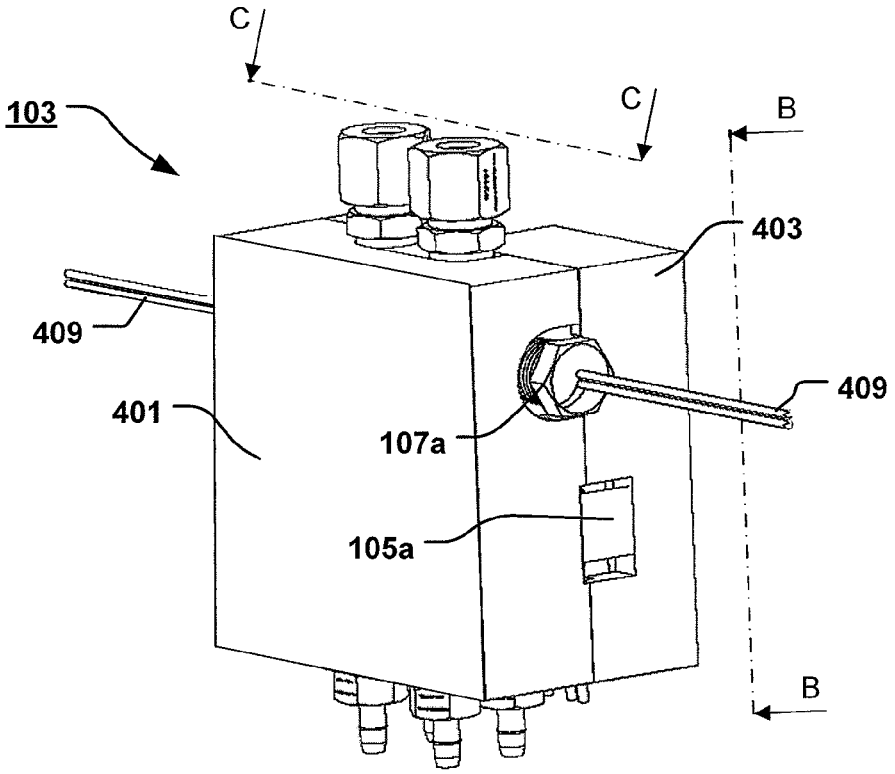
FIG. 4 is a perspective view of an exemplary sensor block assembly.
Figure 4A:
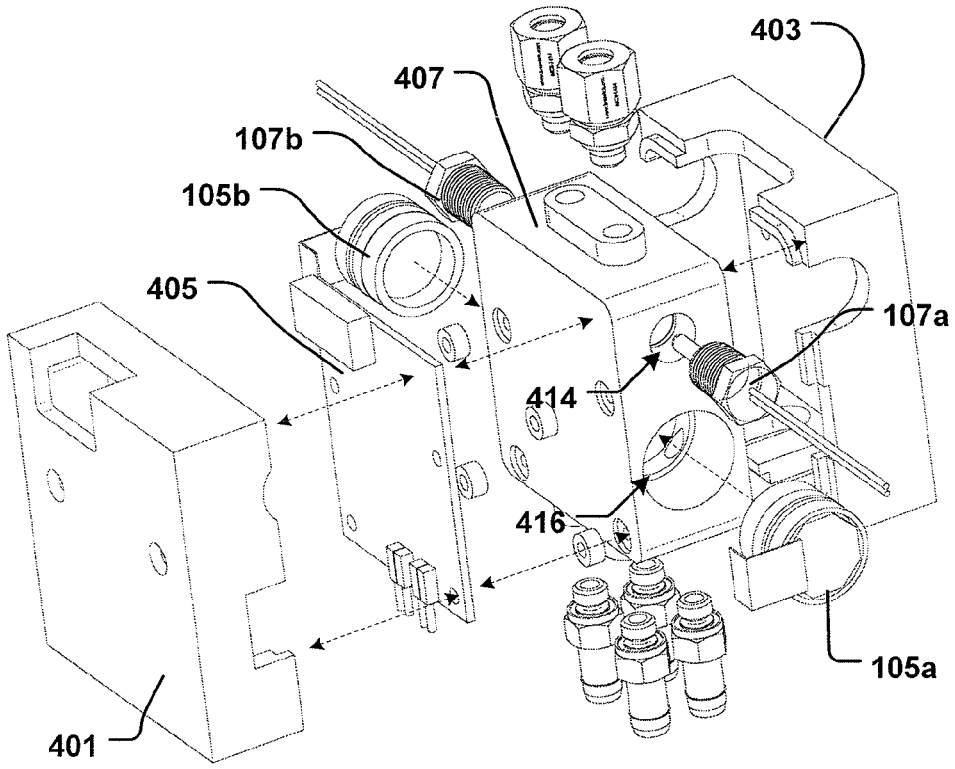
FIG. 4A is an exploded view of the sensor block assembly of FIG. 4.

The exemplary sensor block assembly 103 provides a mounting support structure for temperature and pressure sensors and, as illustrated in FIGS. 4, through 4C. In FIGS. 4 & 4A, the sensor block assembly 103 comprises an outer housing assembly 401, 403 that encapsulates a mounting block 407 and a pressure sensor control board 405. As shown in the section view B-B and C-C, the mounting block 403 includes a supply ink inlet channel 402 defined generally vertically therethrough having an inlet end 404 coupled to the heating assembly 115 outlet 304 and dual outlets 406*a*, 406*b* defined in printhead supply ink conduits 116 which are coupled to corresponding inlets of suitable printheads (not shown). The channel 402 in this example divides (Ref. Pt C) to supply ink to both outlets 406*a*, 406*b*. Similarly, a return ink channel 408 is defined through the mounting block 407 in parallel with the supply ink inlet channel 402 having dual inlets 410*a*, 410*b* defined by return ink conduits 114 coupled to corresponding outlets of suitable printheads (not shown). Inlets 410*a*, 410*b* merge, into a single channel 408 which extends through the block 407 to an outlet 412 which is coupled to the inflow conduit 209 of the recirculation tank 101.

The mounting block 407 further comprises a first pair of mounting boreholes 414*a*, 414*b* defined in opposing block walls, each borehole extending to a depth to intersect its correspondingly nearest channel 402, 408. First and second temperature sensors 107*a*, 107*b*, for example, thermistors, are inserted into boreholes 414*a*, 414*b* such that they will be in contact with fluid as either supply ink or return ink courses through the respective channels 408, 402. Temperature sensors 107 include control leads 409 coupled to the control system which, again, will be discussed in greater detail hereafter. In a similar fashion, the block 403 includes second pair of mounting boreholes 416*a*, 416*b* defined in opposing block walls dimensioned to receive respective pressure sensors 105*a*, 105*b*, for detecting fluid pressure in both the supply ink and the return ink channels 402, 408. In the section views, it can be seen that the pressure sensors 107 are mounted to be in contact with the respective ink flows adjacent or coincident with the respective divides (Ref. C). Further, pressure sensors 107 are coupled to the control board 405 which is, in turn coupled to the control system. In this exemplary embodiment, pressure sensors 107 are co-located within the ink system and near the printheads. However, in an embodiment in which the primary system components (e.g., pumps, tanks, filters, heating assembly, etc.) must be farther away from the printheads, the pressure sensors should still be located near the printhead(s).

As described above, the exemplary system 100 preferably includes an air pump 119 in fluid communication with the recirculation tank 101 via an air 112 coupled to outlet 216. Air pump 119 may be a peristaltic pump that can supply or remove air from the recirculation tank 101 as needed for achieving the desired pressure at the sensor block assembly 103. The air pump 119 operation is controlled by a control system according to an control logic algorithm that is configured to maintain the desired pressure based upon on the current state, but includes running, standby and purging modes. The advantage of a peristaltic pump is that even with power off, the air is pinched and a vacuum in the recirculation tank 101 is maintained. This is a significant feature that saves ink, and reduces user frustration compared to prior systems. In addition, the air line 112 includes an overflow sensor 121 that can detect ink or foam entering the air line 112. In the event the sensor 121 detects ink or ink foam enters the line 112 a detection signal is issued from the sensor 121 to the control system which commands a shut down or a purge of the line.

Those knowledgeable of ink supply system design will appreciate that, typically, conventional systems utilize a bulky, weighty overflow trap tank with a float sensor which trips only after a significant amount of ink overflows. This necessitates adding a maintenance procedure for the user to clean up spilled ink, not to mention wastes significant time and ink. On the other hand, the on-tube overflow sensor 121 trips much earlier, before a significant amount of ink can escape the recirculation tank 101, saving ink and reducing maintenance requirements. In addition, it results in a more compact and lighter weight apparatus that is less expensive than the prior art systems.

The system 100 may advantageously include a structure for introducing new ink comprising a bulk ink supply reservoir 123 coupled to the suction side 116 of a fill pump 125, the outlet of which is coupled to a filter 127. Fill ink 118 is ported to the recirculation tank 101 via the bypass line 110. A check valve 133 may be installed between the filter 127 and the bypass line 110 as well. Check valve 133 remains open during anytime fill ink 118 is being introduced into the system. The purpose of check valve 133 is that the vacuum maintained in the recirculation reservoir 101 can siphon ink from the supply reservoir 123 even when the fill pump 125 is not running. This will cause recirculation reservoir 101 to overfill, causing ink to flow up the air line 112 and shut the system down when the overflow sensor 121 is tripped. Consequently, check valve 133 remains closed when the fill pump 125 is not running.

Furthermore, filters 113, 125 are preferably configured to remove gels and particles from the ink larger than about five microns (5 μ) in size. In addition, a contactor (or degasser) may optionally be included in the ink recirculation path, located anywhere between the recirculation pump 111 outlet and the sensor block assembly 103.

In operation, recirculation pump 111 draws recirculation ink from the recirculation tank 101 which draws the ink from the suction side 104 and impels the ink to flow to the pressure side 106. After passing through filter 113, ink enters the heating assembly 115 from which it exits as heated ink 108 and is conveyed to the sensor block assembly 103 through which it flows before introduction through printhead supply ink conduit 116 into the printhead 109. Temperature and pressure of the ink is measured with temperature sensor 107 and a pressure sensor 105 before the ink flows to the printhead 109. Unejected return ink is drawn through the return conduit 114 back through the sensor block assembly 103, where again temperature and pressure are measured with temperature and pressure sensors, 107, 105, respectively, and return ink 102 exiting from the sensor block assembly 103 is ported back into the recirculation tank 101 again.

In case the pressure side 106 of the recirculation pump 111 experiences an overpressure event, for example, due to a clogged filter or other blockage downstream, e.g., within any of the conduits or in the printhead, check valve 117 will open allowing ink to flow through the bypass line back to the recirculation tank 101. When this occurs, pressure to the supply side of the sensor block assembly 103 as measured by the respective pressure sensor 105 will drop below a minimum threshold, initiating an alert signal that is issued to the control system which is configured to shut down operation until the overpressure event is remediated.

System 100 ink level is monitored by the control system through the fluid level detection assembly 203. In the event ink level reaches a preset minimum threshold, the control system is configured to initiate a re-supply of ink from the bulk supply tank 123 by energizing the fill pump 125.

Figure 5:
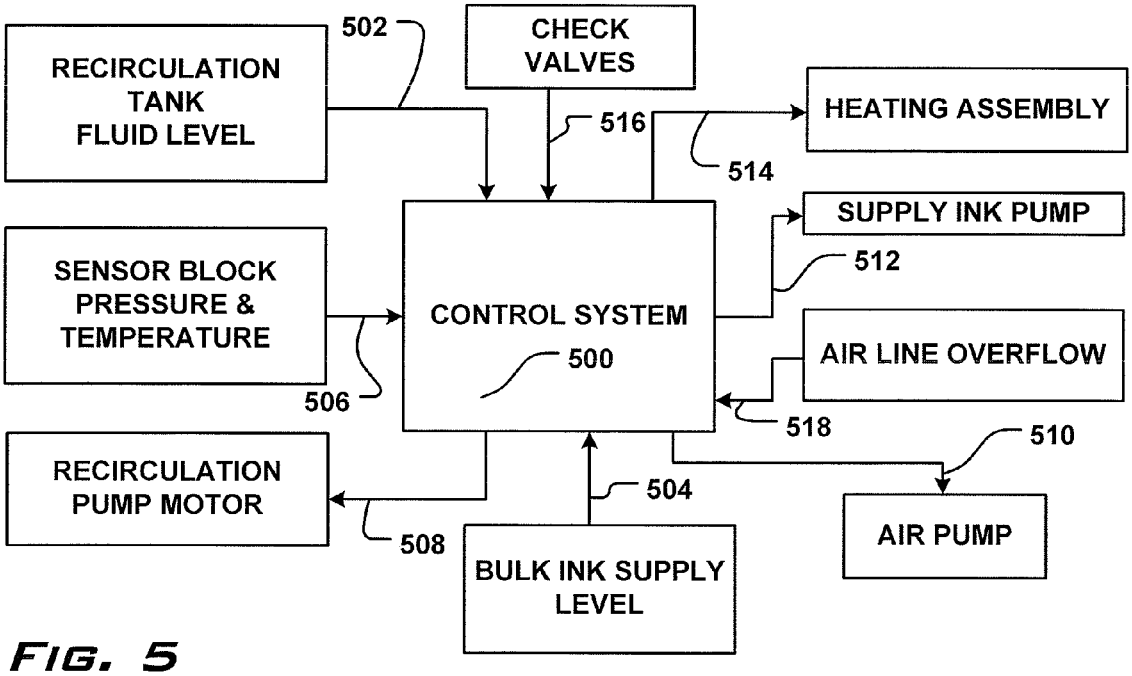
FIG. 5 is a functional schematic of an exemplary control system.

FIG. 5 presents a functional diagram of an exemplary signal network as may be employed within the system 100 wherein the various components, described above, are coupled to a computer-based control system 500. In this particular example, control system 500 is configured to receive as input fluid level information signals 502, 504 from the recirculation tank 100 and the bulk ink supply tank 123, respectively, pressure and temperature signals 506 from the sensor block assembly 103, recirculation pump 111 and/or motor 131 speed 508, as well as fluid detection signal 518 from the air line overflow detector 121. The control system 500 is configured with control logic, described below, which causes the control system 500 to initiate various control commands depending upon the input received, namely: (1) energizing commands 508 to the recirculation pump motor 131 in the event system 100 pressure needs to be increased based on pressure signal 506 received from the sensor block assembly 103; (2) energizing, de-energizing and purge commands 510 to the air pump 119 in the event a vacuum in the recirculation tank abates or, in the case of a de-energizing or purge command, fluid is detected in the air line 112; (3) energizing and de-energizing commands 512 to the supply ink pump 125 in the event fluid level in the system 100 is too low; and (4) energizing commands 514 to the heating assembly 115 in response to temperature signals 506 that indicate ink temperature is outside of an acceptable range for operation. These same information paths are also used to shut the system down in case a check valve 117 is tripped open.

System pressure regulation as described above is achieved through measurement of the pressure at the printhead supply ink 116 and return ink 114 conduits in the sensor block assembly 103 at the inlet and exit of the printhead 109. In one embodiment, the threshold for acceptable system pressure is defined as the pressure differential between the supply ink conduit 116 and the return conduit 114. As stated above, the pressure sensors 105 relay a pressure signal to the control system 500. The control system 500 is configured with control logic which determines the measured differential and compares the measured differential to a threshold value or values, if acceptable system pressure may be a range. If the control system 500 determines the measured pressure differential is outside of acceptable pressure parameters, the control system 500 issues a command signal to the recirculation pump 111 motor 131 to increase or decrease speed, to increase or decrease system pressure, respectively.

Similarly, system temperature regulation is accomplished by measurement of the temperature of the ink at the printhead supply ink conduit 116 and the return ink conduit 114. In one embodiment, a threshold for acceptable system temperature is defined as the average of the temperature with respect to the supply ink 116 and the return ink 114 conduits. The temperature sensors 107 relay temperature signals 506 to the control system 500 which is configured with control logic that determines the average measured temperature and compares the average measured temperature to a threshold value or values (if defined as a range of temperatures). If the control system 500 determines the average measured temperature is outside of acceptable temperature parameters, the control system 500 issues a command signal 514 to the heating assembly to increase or decrease heat within the heating assembly 115.

The control system 500, as will be appreciated by those skilled in the arts, may be one or more computer-based processors. Such a processor may be implemented by a field programmable gated array (FPGA), application specific integrated chip (ASIC), programmable circuit board (PCB), a microcontroller, or other suitable integrated chip (IC) device.

Figure 6:
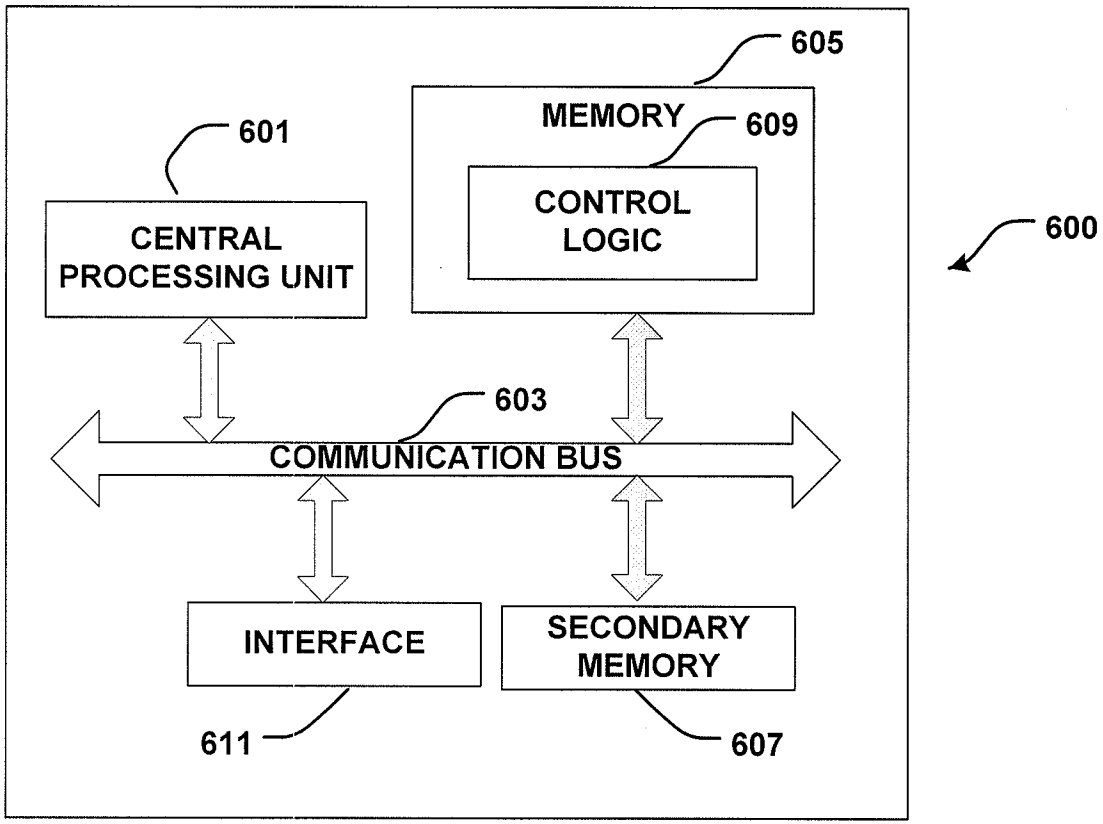
FIG. 6 is a functional schematic of an exemplary computer-based system that may be adapted to function as a control system.

With reference to FIG. 6, a processor 600 in effect comprises a computer system. Such a computer system includes, for example, one or more central processing units (CPUs) 601 that are connected to a communication bus 603. The computer system can also include a main memory 605, such as, without limitation, flash memory, read-only memory (ROM), or random access memory (RAM), and can also include a secondary memory 607. The secondary memory can include, for example, a hard disk drive and/or a removable storage drive. The removable storage drive reads from and/or writes to a removable storage unit in a well-known manner. The removable storage unit, represents a floppy disk, magnetic tape, optical disk, and the like, which is read by and written to by the removable storage drive. The removable storage unit includes a computer usable storage medium having stored therein computer software and/or data.

The secondary memory 607 can include other similar means for allowing computer programs or other instructions to be loaded into the computer system. Such means can include, for example, a removable storage unit and an interface. Examples of such can include a program cartridge and cartridge interface (such as that found in video game devices), a removable memory chip (such as an EPROM, or PROM) and associated socket, and other removable storage units and interfaces which allow software and data to be transferred from the removable storage unit to the computer system.

Computer programs (also called control logic 609) are stored in the main memory and/or secondary memory. Computer programs can also be received via the communications interface. Such computer programs, when executed, enable the computer system to perform certain features of the present invention as discussed herein. In particular, the computer programs, when executed, enable a control processor 600 to perform and/or cause the performance of features of the present invention.

A processor 600, and the processor memory, may advantageously be configured with control logic or other substrate configuration representing data and instructions, which cause the processor to operate in a specific and predefined manner as, described hereinabove. The control logic may advantageously be implemented as one or more modules. The modules may advantageously be configured to reside on the processor memory and execute on the one or more processors. The modules include, but are not limited to, software or hardware components that perform certain tasks. Thus, a module may include, by way of example, components, such as, software components, processes, functions, subroutines, procedures, attributes, class components, task components, object-oriented software components, segments of program code, drivers, firmware, micro-code, circuitry, data, and the like. Control logic may be installed on the memory using a computer interface 611 coupled to the communication bus 603 which may be any suitable input/output device. The computer interface 611 may also be configured to allow a user to vary the control logic, either according to pre-configured variations or customizably.

The control logic conventionally includes the manipulation of data bits by the processor and the maintenance of these bits within data structures resident in one or more of the memory storage devices. Such data structures impose a physical organization upon the collection of data bits stored within processor memory and represent specific electrical or magnetic elements. These symbolic representations are the means used by those skilled in the art to effectively convey teachings and discoveries to others skilled in the art.

The control logic is generally considered to be a sequence of processor-executed steps. These steps generally require manipulations of physical quantities. Usually, although not necessarily, these quantities take the form of electrical, magnetic, or optical signals capable of being stored, transferred, combined, compared, or otherwise manipulated. It is conventional for those skilled in the art to refer to these signals as bits, values, elements, symbols, characters, text, terms, numbers, records, files, or the like. It should be kept in mind, however, that these and some other terms should be associated with appropriate physical quantities for processor operations, and that these terms are merely conventional labels applied to physical quantities that exist within and during operation of the computer.

It should be understood that manipulations within the processor are often referred to in terms of adding, comparing, moving, searching, or the like, which are often associated with manual operations performed by a human operator. It is to be understood that no involvement of the human operator may be necessary, or even desirable. The operations described herein are machine operations performed in conjunction with the human operator or user that interacts with the processor or computers.

It should also be understood that the programs, modules, processes, methods, and the like, described herein are but an exemplary implementation and are not related, or limited, to any particular processor, apparatus, or processor language. Rather, various types of general purpose computing machines or devices may be used with programs constructed in accordance with the teachings described herein. Similarly, it may prove advantageous to construct a specialized apparatus to perform the method control functions described herein by way of dedicated processor systems with hard-wired logic or programs stored in nonvolatile memory, such as, by way of example, read-only memory (ROM), for example, components such as ASICs, FPGAs, PCBs, microcontrollers, or multi-chip modules (MCMs). Implementation of the hardware state machine so as to perform the functions described herein will be apparent to persons skilled in the relevant art(s).

In an embodiment where the invention is implemented using software, the software can be stored in a computer program product and loaded into the computer system using the removable storage drive, the memory chips or the communications interface. The control logic (software), when executed by a control processor, causes the control processor to perform certain functions of the invention as described herein. In yet another embodiment, features of the invention can be implemented using a combination of both hardware and software.

Figure 7:
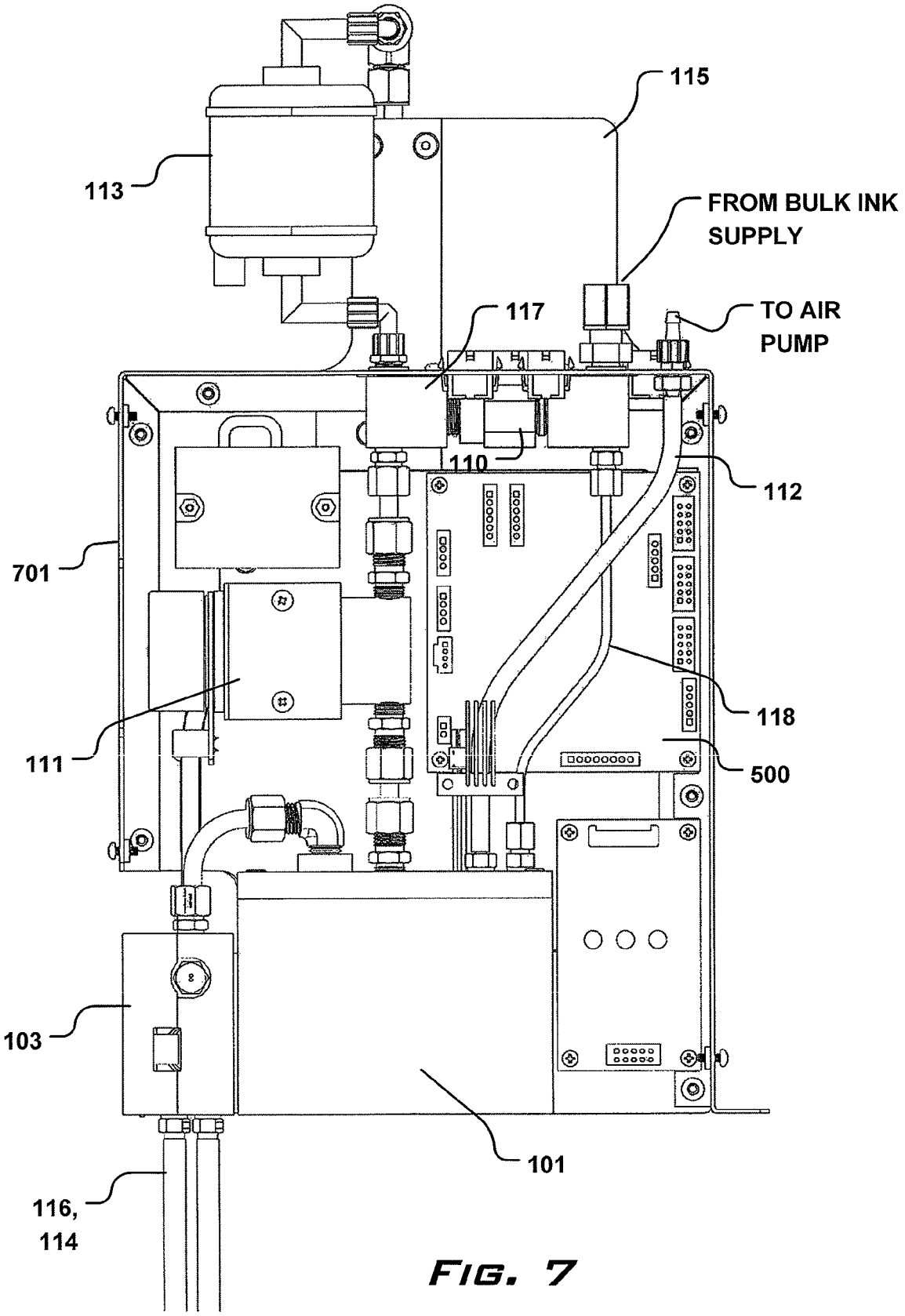
FIG. 7 is an elevational view of an exemplary arrangement of the ink supply system mounted within, or supported by, a housing member.

FIG. 7 illustrates an arrangement of the system 100 which embodies a compact design that is particularly effective in scanning printhead printing applications. The components identified above, namely the recirculation tank 101, the recirculation pump 111, its motor 131, and the control system 500 are mounted in a compact housing 701. The filter 113 is attached to the outlet from the pump extending above the housing 701 with a conduit connecting to the inlet of the heating assembly 115 which is mounted to the rear of the housing 701. The sensor assembly block 103 is mounted on the outside of the housing 701 such that it is connectable to one or more printheads, which may be scanning printheads. Because of its compact design and its light weight, because of the elimination of components heretofore incorporated by prior art systems, the system, comprising an ink circuit mounted to, enclosed within, or otherwise supported by the housing 701 may be completely mounted to the printhead, ie., to a printhead carriage, such that the system travels with the printhead as it traverses the print media.

It will be appreciated that the system 100 embodies several advantages over conventional recirculating ink supply systems. The compact system 100 needs far less space and weighs far less than previous systems so that it is suitable for use with scanning (i.e., moving with respect to the print media) printhead printers. The lack of complexity achieves a greater degree of reliability, less leakage, in addition to being easier to trouble-shoot in case a problem occurs. The compact design also costs less to manufacture resulting in a less expensive alternative for the printing industry.

The effectiveness of this novel design provides several advantages as well. For example, the recirculation tank 101 design coupled with the air pump results in less air foam in the ink circuit. Moreover, most prior systems use two recirculation tanks 101. The fact that only one recirculation tank 101 is required in the presently described system is a significant advantage in size, weight and cost. It eliminates the bulk and weight resulting from a second tank, level sensor, air pump and overflow detector. The system 100 is extremely responsive to adjustment. For example, as stated above, the speed of the recirculation pump 111 controls the differential pressure of the ink from the supply side to the return side pressure sensors. Changing the pump speed results in a virtually immediate (e.g., about 200 milliseconds or less) change in differential pressure measured at the sensor block assembly 103. An additional advantage of one embodiment of the present design is that the air pump 119 controls the return side pressure, therefore both the differential pressure and the return side pressure measurements can be used to closely maintain respective target pressures. In firmware, the recirculation pump is controlled to maintain the pressure difference and the air pump is controlled to maintain the return side target pressure. The heating assembly 115 design of the spiraled conduit 303 coupled with the speed of the ink within the circuit increases responsiveness to changes in temperature as well. System responsiveness is especially desirable in high-tempo, or dynamic printing conditions such as sustained high volume usage of ink or multiple instantaneous starting and stopping of the attached printhead jetting.

This design also results in the significant advantage that multiple self-contained, independently controlled ink supply systems 100 may be installed on a printer. In conventional large print applications with large printhead arrays or multi-color large print applications, ink supply systems often share a single control system and a vacuum pump, requiring a very complex control algorithm and often resulting in additional maintenance. Moreover, in such prior systems, multiple different types of inks may be used, each perhaps requiring unique temperature and pressure deposition parameters that a single control system must monitor with multiple sensors and control with multiple pumps. Contrariwise, the system disclosed herein includes a dedicated control system, sensor array and controls, so the system 100 may be individually tailored to a specific ink independently of how other systems 100 are configured.

As described above and shown in the associated drawings, the present invention comprises an ink supply system for ink jet printers that require recirculating ink. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the system.

What is claimed is:

1. An ink supply system for ink jet printers comprising:

a first reservoir for containing a recirculating ink supply, said first reservoir having an outlet and an inlet;

a recirculation pump configured to provide a substantially pulseless flow of ink within said system, said recirculation pump having a suction side for receiving a supply of ink from said outlet and a pressure side;

a heating assembly having an inlet for receiving ink from said pressure side with a filter interposed therebetween, and having an outlet, said heating assembly comprising:

an ink conduit formed into a spiral; and first and second heating elements in thermal contact with either side of said spiral;

a printhead ink supply conduit to which is mounted a first pressure sensor and a first temperature sensor to detect supply ink pressure and temperature;

a recirculating ink jet printhead having an supply ink intake for receiving supply ink from said printhead supply conduit and return outlet for conveying unejected ink;

a return ink conduit for receiving ink from said return outlet, said return ink conduit being in fluid communication with said inlet to first reservoir and comprising a second pressure sensor and a second temperature sensor mounted thereto to detect return ink pressure and temperature.

2. The ink supply system of claim 1, further comprising:

an air pump in fluid communication with said first reservoir selectively energizeable for maintaining low pressure within said first reservoir.

3. The ink supply system of claim 1, further comprising:

a second reservoir in fluid communication with said first reservoir for containing fill ink for introduction into said system.

4. The ink supply system of claim 3, further comprising:

an air pump in fluid communication with said first reservoir selectively energizeable for maintaining low pressure within said first reservoir.

5. The ink supply system of claim 1, further comprising:

a bypass conduit interposed between said pressure side of said recirculation pump and in fluid communication with said first reservoir, said bypass conduit including a pressure regulating valve.

6. The ink supply system of claim 5, further comprising:

a second reservoir in fluid communication with said first reservoir for containing fill ink for introduction into said system.

7. The ink supply system of claim 6, further comprising:

an air pump in fluid communication with said first reservoir selectively energizeable for maintaining low pressure within said first reservoir.

8. An ink supply system for a printer having a scanning printhead, said ink supply system comprising:

a housing member mounted to the scanning printhead of a printer such that said housing member travels with the printhead as the printhead scans;

an ink fluid circuit supported substantially within said housing member, said ink fluid circuit comprising:

a recirculation tank enclosed within said housing member;

a recirculation pump enclosed within said housing member, said pump configured to substantially pulselessly draw ink from said recirculation tank and to substantially pulselessly impel ink within said circuit;

a heating assembly mounted to said housing member for heating ink impelled by said recirculation pump;

a sensor assembly comprising first and second pressure sensors and first and second temperature sensors mounted to said housing member and configured to detect the pressure and temperature of:

ink received from said heating assembly; and return ink received from one or more printheads; and a control system housed within said housing member and configured to be responsive to said sensors and operable to adjust said recirculation pump speed and temperature of said heating assembly; and wherein said recirculation tank is in fluid communication with an air pump operable for maintaining low pressure within said recirculation tank.

9. The ink supply system of claim 8, wherein said heating assembly comprises a conduit through which ink is conveyed, said conduit formed into a double-spiral and in thermal contact with one or more heating elements.

10. The ink supply system of claim 9, wherein said ink fluid circuit further comprises a bypass line for conveying ink impelled by said recirculation pump into said recirculation tank in the event fluid pressure within said circuit increases beyond a threshold value.

11. The ink supply system of claim 8, wherein said control system is a computer-based processor having a memory configured with control logic for:

obtaining a measured differential pressure derived from said sensor assembly;

obtaining a measured temperature derived from said sensor assembly;

comparing said measured differential pressure to at least one pre-defined acceptable pressure and said measured temperature to at least one pre-defined acceptable temperature;

varying the speed of said recirculation pump in response to said comparison; and varying heat generated by said heating assembly in response to said comparison.

12. The ink supply system of claim 11, wherein said recirculation tank is in fluid communication with an air pump operable for removing air from said recirculation tank.

13. The ink supply system of claim 12, wherein said heating assembly comprises a conduit through which ink is conveyed, said conduit formed into a double-spiral and in thermal contact with one or more heating elements.

14. The ink supply system of claim 13, wherein said ink fluid circuit further comprises a bypass line for conveying ink impelled by said recirculation pump into said recirculation tank in the event fluid pressure within said circuit increases beyond a threshold value.

15. An ink fluid circuit for ink jet printers comprising:

a gear pump for providing a substantially constant ink fluid pressure, said pump having an outlet in fluid communication with an inlet of a heating assembly for heating ink fluid;

a first temperature sensor and a first pressure sensor mounted in functional contact with ink heated by said heating assembly;

a second temperature sensor and a second pressure sensor mounted in functional contact with ink received from a recirculating printhead; and a control system responsive to said first and second temperature sensors and said first and second pressure sensors and configured to adjust a pump speed and heat generated by said heating assembly;

a single recirculation reservoir into which ink received from the printhead is ported and from which said gear pump draws ink fluid; and a peristaltic air pump for maintaining a substantial vacuum within said reservoir.

16. The ink supply circuit of claim 15, further comprising a supply tank disposed externally to said circuit and adapted to selectively introduce ink into said circuit, said supply tank configured to be in fluid communication with said single recirculation reservoir.

* * * * *